US011780262B1

(12) United States Patent
Gleason

(10) Patent No.: US 11,780,262 B1
(45) Date of Patent: Oct. 10, 2023

(54) PLACEMENT TOOL

(71) Applicant: Gelli Arts LLC, Philadelphia, PA (US)

(72) Inventor: Lou Ann Gleason, Philadelphia, PA (US)

(73) Assignee: GELLI ARTS LLC, Philadelphia, PA (US)

( * ) Notice: Subject to any disclaimer, the term of this patent is extended or adjusted under 35 U.S.C. 154(b) by 0 days.

(21) Appl. No.: 17/588,763

(22) Filed: Jan. 31, 2022

Related U.S. Application Data

(60) Provisional application No. 63/144,621, filed on Feb. 2, 2021.

(51) Int. Cl.
*B44D 3/22* (2006.01)
*B43L 7/00* (2006.01)
*B43L 12/00* (2006.01)

(52) U.S. Cl.
CPC ..... *B44D 3/22* (2013.01); *B43L 7/005* (2013.01); *B43L 7/007* (2013.01); *B43L 12/00* (2013.01)

(58) Field of Classification Search
CPC ..... B43L 7/005; B43L 7/007; B43L 12/00
See application file for complete search history.

(56) References Cited

U.S. PATENT DOCUMENTS 1,672,751 A * 6/1928 Conti ..... 33/564
2,172,829 A * 9/1939 Blinsinger ..... A47B 27/00 101/301
2,614,360 A * 10/1952 Hite ..... B43L 13/043 33/1 AA
2,655,188 A * 10/1953 Catching, Jr. ..... E04G 21/1891 269/45
2,696,867 A * 12/1954 Wensink ..... B41B 23/00 156/379
3,899,839 A * 8/1975 Essmann ..... G09B 21/002 434/117
4,223,447 A * 9/1980 Greenlees ..... B43L 13/004 434/117
4,230,513 A * 10/1980 Cugini, Sr. ..... G09F 7/16 156/562
4,295,275 A * 10/1981 Cugini, Sr. ..... G09F 7/16 33/1 G
4,679,328 A * 7/1987 Saad ..... B43L 13/041 33/447

(Continued)

OTHER PUBLICATIONS

Gelli Arts; website; Creating inked details on prints with Bob Pennycook Lesson Plan; Jun. 10, 2020; p. 1-7; https://gelliartsblog.com/2020/06/10/creating-inked-details-on-prints-with-bob-pennycook/.

(Continued)

*Primary Examiner* — Yaritza Guadalupe-McCall
(74) *Attorney, Agent, or Firm* — Wyatt, Tarrant & Combs, LLP; Max E. Bridges; Matthew A. Williams

(57) ABSTRACT

A printmaking placement tool that permits multiple aligned and layered prints comprising a main body, a plurality of paper guides, and a plurality of bores located in a top surface of the main body that are adapted to receive and engage the plurality of a paper guides. In some embodiments, a bottom surface of each of the plurality of paper guides includes an at least one protrusion adapted to be received in the plurality of bores. In further embodiments, the placement tool comprises a main body having a raised outer edge and no paper guides or corresponding bores are utilized.

16 Claims, 4 Drawing Sheets

(56) References Cited

U.S. PATENT DOCUMENTS

| | | | | | |
|---|---|---|---|---|---|
| 5,337,484 | A * | 8/1994 | Cardon | B43L 13/201 | 33/41.2 |
| 5,555,631 | A * | 9/1996 | Houston | B43L 11/055 | 33/31 |
| 5,915,807 | A * | 6/1999 | Ilagan | B43L 13/08 | 33/425 |
| 6,049,990 | A * | 4/2000 | Holland | B43L 7/02 | 33/468 |
| 7,153,076 | B2 * | 12/2006 | Parker | B42C 9/0056 | 412/37 |
| 7,409,773 | B1 * | 8/2008 | Gioia | B43L 7/00 | 33/527 |
| 9,597,909 | B2 | 3/2017 | Myska | | |
| 9,731,531 | B2 | 8/2017 | Myska | | |
| 9,849,705 | B2 | 12/2017 | Myska | | |
| 9,925,812 | B1 | 3/2018 | Myska | | |
| 9,931,875 | B2 | 4/2018 | Myska | | |
| D847,260 | S | 4/2019 | Myska | | |
| 2006/0141427 | A1 * | 6/2006 | Harrigan | G09B 23/04 | 434/211 |

OTHER PUBLICATIONS

Gelli Arts; website; Monoprinting: Painting with Shop Towels by Bob Pennycook; Dec. 10, 2020; pp. 1-10; https://gelliartsblog.com/2020/12/10/monoprinting-painting-with-shop-towels/.

* cited by examiner

PLACEMENT TOOL

CROSS-REFERENCE TO RELATED APPLICATIONS

This patent application claims the benefit of and priority to U.S. Provisional Patent Application Ser. No. 63/144,621, with a filing date of Feb. 2, 2021, the contents of which are fully incorporated herein by reference.

FIELD OF INVENTION

The embodiments described herein relate to placement tools for printmaking, including but not limited to, creating layered prints and registration.

BACKGROUND

Printmaking refers to the process of creating artwork by printing, typically on paper. Monotyping is a type of printmaking in which an image is drawn or painted on a smooth, non-absorbent surface (referred to herein as a "plate" or "pad") and then the image is transferred onto a sheet of paper (or any suitable surface) by pressing the two together, typically by press or by hand. In monotyping, the plate is featureless and contains no features that will impart any definition to successive prints. Accordingly, the image is entirely dependent on the unique inking or painting added to the plate, resulting in one unique print.

Sometimes artists (also referred to herein as a "user" or "users") desire to add multiple layers of paint or ink to the same print. Similarly, artists also desire to layer printed patterns to form a multicolor pattern which is referred to as registration. However, it is challenging to add successive layers to the same location on the paper as the prior layer(s) because it is difficult to align and center the paper at the same position on the plate. This is particularly difficult when users are pressing the plate and the paper together by hand because the user often cannot see the location of the print on the paper during the transfer process.

Accordingly, there is a significant need for a placement tool which centers and aligns the plate and the paper to permit multiple-layered prints, and which permits easier registration. Along with other features and advantages outlined herein, the placement tool within the scope of present embodiments meet these and other needs. In doing so, the placement tool easily permits layering and registration because the plate and paper are centered in the same location each time a new layer is added. The placement tool also allows the prints to be positioned in the center of the paper. Furthermore, the placement tool, according to multiple embodiments and alternatives, is portable, less expensive than conventional tools, and is easier to clean and store.

SUMMARY OF EMBODIMENTS

According to multiple embodiments and alternatives, the placement tool comprises a main body which is a single component generally in the shape of the letter "L," and is adapted to receive a plate or pad. In further embodiments, a top surface of the placement tool defines a plurality of bores which are adapted to receive a plurality of paper guides.

In some embodiments, the main body consists of a first component (which is generally in the shape of a long and narrow rectangle) integrally connected to second component. In some embodiments, the first component is generally in the shape of a long and narrow rectangle and the second component is generally in the shape of a shorter and wide rectangle relative to the first component. In other embodiments, the first component is a shorter and wider rectangle relative to the second component, and any number of widths and lengths may be utilized as desired by the user.

The first component connects to the second component to form a plate receiving corner. In some embodiments, the plate receiving corner is curved and adapted to receive the corresponding curved edge of a plate. In further embodiments, the first component connects to the second component at about a ninety degree angle to receive a plate having a sharper corner or edge. The first and second components further define a plurality of external edges and a pair of internal edges. The pair of internal edges and the plate receiving corner are adapted to receive a plate or a pad.

In some embodiments, an additional component is positioned along the outer edge of the main body and consists of a different color than the main body (e.g. neon as a non-limiting example). In this embodiment, the additional component is positioned higher than the top surface of the main body, and no paper guides (or corresponding bores) are utilized with the placement tool. In further embodiments, the main body further comprises a plurality of bores which are adapted to receive the protrusions (e.g. pegs as a non-limiting example) of the paper guides (as explained in more detail below), and the additional component along the outer edge is not included.

According to multiple embodiments and alternatives, the bottom surface of each of the plurality of paper guides comprises at least on protrusion (e.g. a pair of pegs as a non-limiting example) which are adapted to be received in the plurality of bores located within the main body. In addition to pegs, it will be appreciated by one of ordinary skill in the art that other structures and shapes may be used to attach the plurality of paper guides to the main body.

In some embodiments, the plurality of paper guides comprise a first paper guide, a second paper guide, and a third paper guide. The first and second paper guides each have an internal edge, external edges, and are generally in the shape of a rectangle except two of the corners along the external edges are rounded, according to multiple embodiments and alternatives. In some embodiments, the second paper guide has a shorter length then the first paper guide.

The third paper guide is generally in the shape of the letter "L". The third paper guide comprises a first unit (which is generally in the shape of a long and narrow rectangle) integrally connected to a second unit (which is generally a shorter and wider rectangle relative to the first component). In some embodiments, the first unit connects to the second unit at a ninety degree angle to form a paper receiving corner, a plurality of external edges, and a pair of internal edges. The paper receiving corner is adapted to receive the corner of a piece of paper (or any suitable material for receiving the print).

In some embodiments, the plurality of bores comprise a plurality of first paper guide bores, a plurality of second paper guide bores, and a plurality of third paper guide bores, each of which are adapted to receive the protrusion(s) of the respective paper guide. Moreover, the plurality of bores are adapted to accommodate plates of various sizes, including the non-limiting examples of 3×5 inches, 5×7 inches, 6×6 inches, and 8×10 inches. A person of ordinary skill in the art will appreciate that any number of plate sizes and configurations may be utilized, including, but not limited to, international paper sizes such as A4, A5, A6, A7, and others. In some embodiments, the main body further includes markings for the various sized plates to indicate to the user where to properly attach the plurality of paper guides to the main body for the respective plate.

According to multiple embodiments and alternatives, the plate is always received in the plate receiving corner (regardless of the size of the plate), but the location of where the plurality of paper guides are attached to the main body will change based on the size of the plate selected by the user. In some embodiments, the main body comprises one piece of clear acrylic, the plurality of paper guides are also made of a single piece of clear acrylic, and the pegs are made of a metal; however, any type of material known by one of ordinary skill in the art will be suitable. In a non-limiting example, the main body is ⅜" thick, but any suitable thickness may be selected by the user. In some embodiments, it is desirable for the thickness of the main body to be identical to the thickness of the plate or pad which will permit an easier transfer of the image to the paper.

Accordingly, the placement tool permits multiple, aligned and layered prints, thus providing a key advantage over conventional approaches, along with other features and advantages disclosed herein.

BRIEF DESCRIPTION OF THE FIGURES

The drawings and embodiments described herein are illustrative of multiple alternative structures, aspects, and features of the present embodiments, and they are not to be understood as limiting the scope of present embodiments. It will be further understood that the drawing Figures described and provided herein are not to scale, and that the embodiments are not limited to the precise arrangements and instrumentalities shown.

MULTIPLE EMBODIMENTS AND ALTERNATIVES

Figure 1:
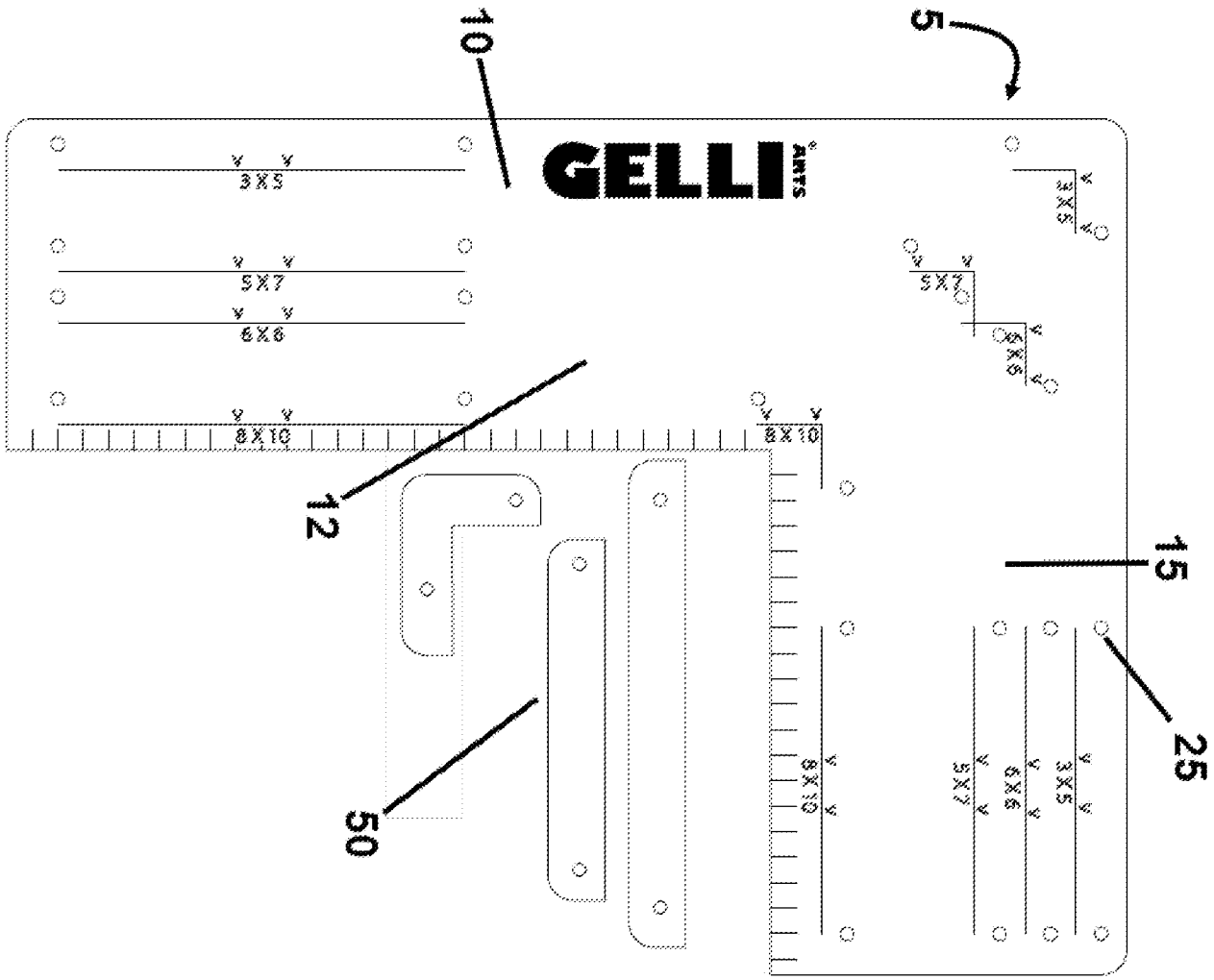
FIG. 1 is plan view of a placement tool having a main body and a plurality of paper guides, according to multiple embodiments and alternatives.

FIG. 1 illustrates a placement tool 5, according to multiple embodiments and alternatives. Placement tool 5 comprises a main body 10 and a plurality of paper guides 50. The main body 10 consists of a first component 12 integrally connected to a second component 15 which generally form an L-shaped main body 10. In some embodiments, both the first and second components 12, 15 are generally in the shape of a rectangle. According to multiple embodiments and alternatives, the first component 12 has a longer length than the second component 15, but a shorter width than the second component 15. As discussed in more detail below, a top surface of the main body 10 also defines a plurality of bores 25 which are adapted to receive the at least one protrusion (e.g. a pair of pegs as a non-limiting example) that extend from the bottom surface of each of the plurality of paper guides 50.

Figure 2:
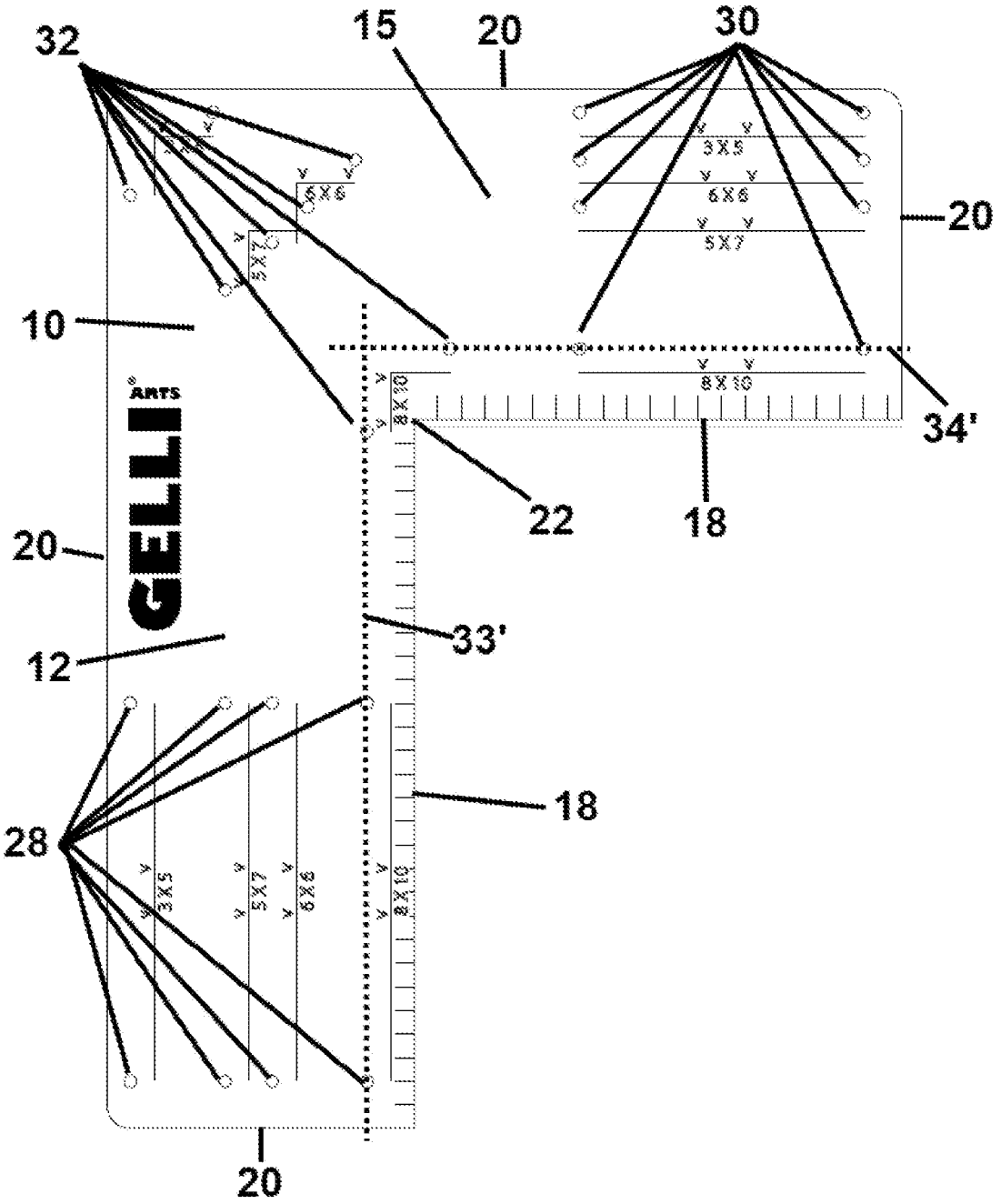
FIG. 2 is a plan view of a main body of a placement tool, according to multiple embodiments and alternatives.

FIG. 2 illustrates the main body 10 comprising the first and second components 12, 15 integrally connected to one another at about a ninety degree angle, according to multiple embodiments and alternatives. As shown in FIG. 2, main body 10 defines a pair of internal edges 18 (also referred to herein as a first and second internal edge) and defines a plurality of external edges 20. The pair of internal edges 18 intersect to form the plate receiving corner 22 (which is adapted to receive the corner of a plate or pad). In some embodiments, the plate receiving corner 22 is rounded (or curved) and adapted to receive a rounded corner of a pad. In other embodiments, the corner 22 is positioned at about a ninety degree angle to receive a pad or plate having a sharp corner. In some embodiments, the plurality of bores 25 consist of a plurality of first paper guide bores 28, a plurality of second paper guide bores 30, and a plurality of third paper guide bores 32. The plurality of first paper guide bores 28 (also referred to herein as one or more pairs of first paper guide bores) are adapted to receive the pegs of the first paper guide 55 and are located within the first component 12. The plurality of second paper guide bores 30 (also referred to herein as one or more pairs of second guide bores) are adapted to receive the pegs of the second paper guide 58 and are located within the second component 15. Likewise, the plurality of third paper guide bores 32 are adapted to receive the pegs of the third paper guide 65. In some embodiments, the third paper guide 65 has a first and second protrusion (or pair of pegs as a non-limiting example) and the corresponding plurality of third paper guide bores 32 are adapted to receive the first and second protrusions of the third paper guide (and are sometimes referred to herein as the first boring and the second boring). In some embodiments, the third paper guide borings 32 for additional sized plates are referred to as the third and fourth borings, and so forth as the plate sizes changes.

The plurality of bores 25 formed by main body 10 are adapted to accommodate plates and papers of various sizes, and the various bores 25 for the respective plate size are positioned distal to one another. As indicated by the non-limiting markings on main body 10 in FIGS. 1-2 and 4, placement tool 5 can be adjusted for plates that are a variety of sizes, including the following dimensions (as non-limiting examples): 3×5 inches, 5×7 inches, 6×6 inches, 8×10 inches, and any other size as desired by the user. To accommodate the various sizes, the first pair of first paper guide borings and the first boring for the third paper guide 65 are positioned the same distance from the first internal edge of the main body 10. Likewise, the first pair of second guide borings and the second boring are each positioned the same distance from the second internal edge of the main body 10. Furthermore, the borings for the additional sized plates are also situated the same distance from the respective internal edge of the main body 10. Accordingly, one of ordinary skill in the art will appreciate that the plurality of the plurality of bores 25 for the particular plate size are positioned the same distance from the respective internal edge of the main body 10 and, as explained below, the respective borings form two straight lines that intersect each other at about a ninety degree angle. This relationship between the plurality of bores 25 and the internal edges of the main body 10 more easily permits layering and registration using placement tool 5, and creates prints in the center of the paper; all of which are clear advantages over the conventional approaches.

As a non-limiting example, the various bores indicated by "8×10" are each positioned the same distance from the respective internal edge 18, and form dashed lines 33' and 34' (illustrated in FIG. 2) which intersect at about a ninety degree. Likewise, the bores indicated by "6×6" are positioned the same distance from respective internal edge 18 and form two lines (not numbered) which intersect at about a ninety degree angle, and so forth. Accordingly, it will be appreciated that the plurality of bores 25 permit placement tool 5 to accommodate plates and papers of a variety of sizes.

Figure 3:
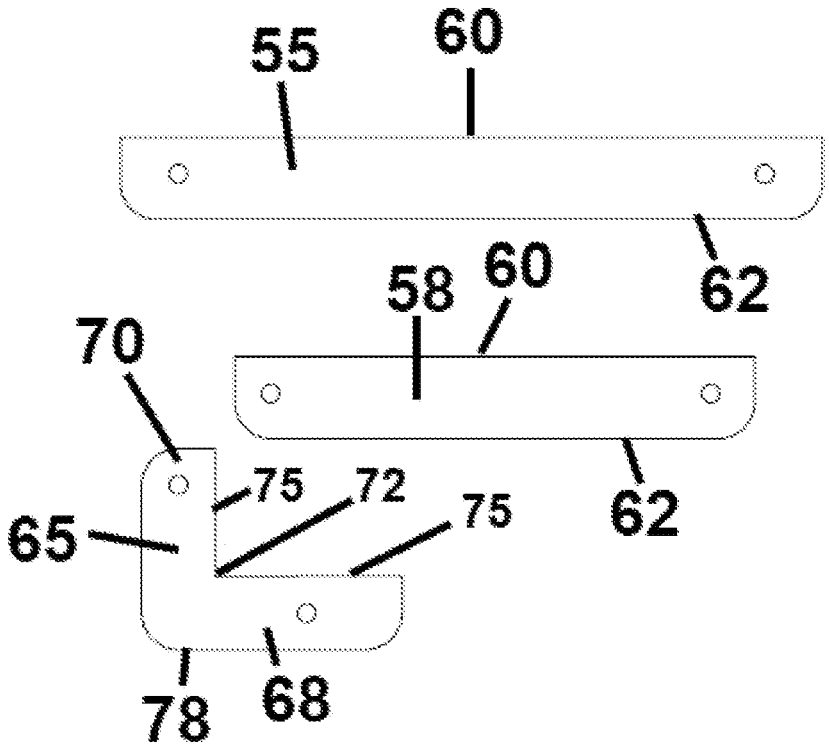
FIG. 3 is a plan view of a plurality of paper guides, according to multiple embodiments and alternatives.

FIG. 3 illustrates the plurality of paper guides 50 consisting of the first paper guide 55, the second paper guide 58, and the third paper guide 65. The first and second paper guides 55, 58 are each rectangular in shape and each form an internal edge 60 and external edges 62. As shown in FIG. 3, the first and second paper guides 55, 58 are both rectangular in shape with a pair of rounded corners and a pair of sharp corners along the internal edge 60 which form about ninety degree angles, according to multiple embodiments and alternatives. In some embodiments, the first paper guide 55 is longer in length than the second paper guide 58.

As shown in FIG. 3, the third paper guide 65 comprises a single component that is generally in the shape of an "L" and consists of a first unit 68 integrally connected to a second unit 70. The first unit 68 and the second unit 70 each form a pair of internal edges 75 and a plurality of external edges 78. In some embodiments, the internal edges 75 intersect at about a ninety degree angle to form a paper receiving corner 72. Likewise, the external edges 78 intersect the internal edges 75 at about a ninety degree angle. According to multiple embodiments and alternatives, as shown in FIG. 3, the three remaining corners (defined by the external edges 78) are rounded. In some embodiments, the first unit 68 has a longer length than the second unit 70. As shown in FIG. 3, the third paper guide 65 further comprises a plurality of rounded corners and a plurality of corners which form ninety degree angles.

While not illustrated in the figures, the first, second, and third paper guides 55, 58, 65 each have at least one protrusion (not numbered), according to multiple embodiments and alternatives, which extends upward or downward relative to the flat plane of FIG. 3. Each of the paper guides 55, 58, and 65 comprises a top surface and a bottom surface, and the at least one protrusion extends from the bottom surface of each paper guide (and the protrusion(s) are positioned adjacent to the opposing ends of the respective paper guide). For example, in FIG. 3, a pair of pegs are located where the pair of circles are illustrated on each of the plurality of paper guides 50. As previously mentioned, the plurality of bores 25 formed by the main body 10 are adapted to receive the protrusion(s) of the plurality of paper guides 50.

In operation, a user first attaches the plurality of paper guides 50 to the bores on the main body 10 corresponding to the dimensions of the desired plate, such that the internal edges of the plurality of paper guides 50 face inward towards the pair of internal edges 18 of the main body 10. For example, assuming a user has a 8×10 plate, as shown in FIG. 4 the plurality of paper guides 50 are attached to the position marked by "8×10" on the main body 10, the internal edges of the plurality of paper guides 50 face inward towards the pair of internal edges 18, and the rounded corners of the plurality of paper guides 50 face outward.

Figure 4:
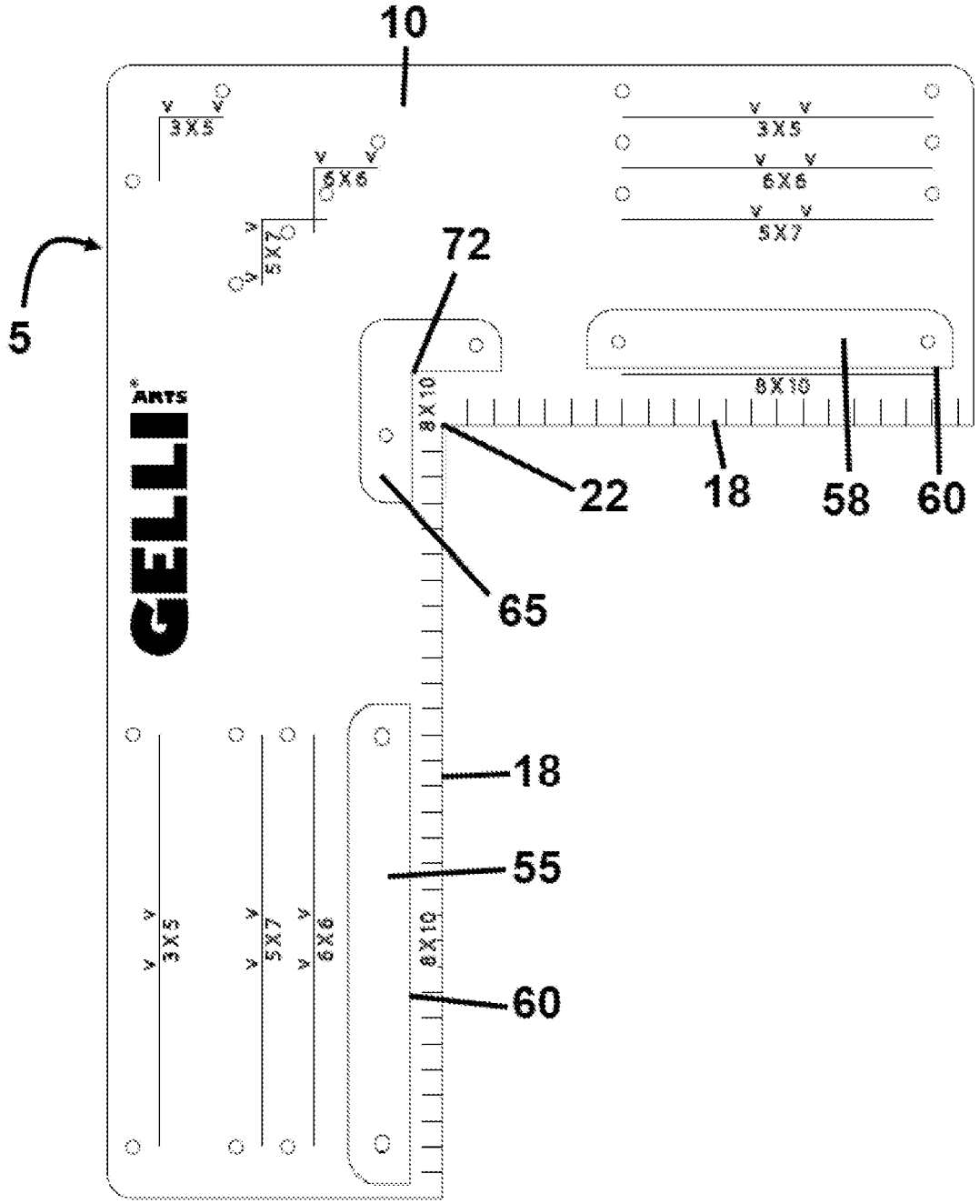
FIG. 4 is a plan view of a plurality of paper guides received in and attached to a main body of a placement tool, according to multiple embodiments and alternatives.

As illustrated in FIG. 4, the pegs of the first paper guide 55 are inserted into the plurality of first paper guide bores 28 which correspond to the "8×10" markings. Likewise the pegs of the second paper guide 58 are inserted into the plurality of second paper guide bores 30 which correspond to the "8×10" markings, and the pegs of the third paper guide 65 are inserted into the plurality of third paper guide bores 32 which correspond to the "8×10" markings. Once the plurality of paper guides 50 are attached to the main body 10 (as shown in FIG. 4), the user applies an image to the plate or pad (not shown) via ink, paint, or any suitable method. When the image on the plate is complete, the user slides the plate towards the placement tool 5 (typically on a flat surface such as a table) until the corner of the plate engages the plate receiving corner 22 and the sides of the plate engage the pair of internal edges 18. In this position, the image on the plate is facing upwards. Next, the user moves the paper (or any suitable material to receive the image) until the corner of the paper (not shown) engages the paper receiving corner 72 of the third paper guide 65 and the paper engages the internal edges 60 of the first and second paper guides 55, 58. Once positioned, the user presses the paper and the plate together to transfer the image. Once the transfer is complete, the user removes the paper from the plate. To add additional layers, the user can clean the plate and add a new image. Alternatively, the user can choose not to clean the plate and can proceed with additional layering as desired. Once the image is ready, the user will repeat the positioning steps mentioned above which will ensure the paper and plate are aligned in the same position for each layer transfer.

If a user desires to utilize a different sized plate or pad, then the user will move the plurality of paper guides 50 to the corresponding position within main body 10. For example, if a user desires to move from the "8×10" position illustrated in FIG. 4 to the "6×6" position, than the user will move the plurality of paper guides 50 to the bores marked by "6×6." As previously mentioned, it will be appreciated that any number of plate and paper sizes can be selected by the user.

It will be understood that the embodiments described herein are not limited in their application to the details of the teachings and descriptions set forth, or as illustrated in the accompanying figures. Rather, it will be understood that the present embodiments and alternatives, as described and claimed herein, are capable of being practiced or carried out in various ways.

Also, it is to be understood that words and phrases used herein are for the purpose of description and should not be regarded as limiting. The use herein of "including," "comprising," "e.g.," "containing," or "having" and variations of those words is meant to encompass the items listed thereafter, and equivalents of those, as well as additional items.

Accordingly, the foregoing descriptions of several embodiments and alternatives are meant to illustrate, rather than to serve as limits on the scope of what has been disclosed herein. The descriptions herein are not intended to be exhaustive, nor are they meant to limit the understanding of the embodiments to the precise forms disclosed. It will be understood by those having ordinary skill in the art that modifications and variations of these embodiments are reasonably possible in light of the above teachings and descriptions.

What is claimed is:

1. A placement tool for printmaking, comprising:

a main body having an L-shape, wherein the main body further comprises a top surface and a bottom surface; and a plurality of paper guides;

wherein the top surface of the main body defines a plurality of bores which are adapted to receive the plurality of paper guides;

wherein the main body further comprises a first component integrally connected to a second component, wherein the first and second components are each in the shape of a rectangle;

wherein the main body further comprises a pair of internal edges, said pair of internal edges intersecting one another to form a plate receiving corner being adapted to receive a corner of a plate;

wherein the plate receiving corner is curved and adapted to receive a corner of a plate having a curved edge.

2. The placement tool of claim 1, wherein the first and second components each have a pair of opposing lengths and a pair of opposing widths, wherein a length of the pair of opposing lengths of the first component is greater than a length of the pair of opposing lengths of the second component, wherein a width of the pair of opposing widths of the first component is shorter than a width of the pair of opposing widths of the second component.

3. The placement tool of claim 1, wherein each of the plurality of paper guides further comprise a top surface and a bottom surface, wherein an at least one protrusion extends from the bottom surface of each of the plurality of paper guides, wherein the at least one protrusion is adapted to be received in the plurality of bores of the main body.

4. The placement tool of claim 3, wherein one of the plurality of paper guides is adapted to receive a corner of a piece of paper.

5. A placement tool for printmaking, comprising:

a main body having a first component integrally connected to a second component, wherein the first and second components each have a rectangular shape, a top surface, and form an L-shaped main body, wherein the main body further comprises a first internal edge, a second internal edge, and a plurality of external edges formed by said first and second components;

a first paper guide and a second paper guide, wherein the first paper guide and the second paper guide are each rectangular in shape, wherein the first paper guide and the second paper guide each have a bottom surface, a pair of opposing ends, an internal edge and an external edge, wherein a protrusion is positioned adjacent to each of the opposing ends of the first paper guide and the second paper guide, wherein each of said protrusions extends from the bottom surface of each of the first paper guide and the second paper guide;

a third paper guide having a first unit integrally connected to a second unit, wherein the first and second units each have a rectangular shape and form an L-shaped third paper guide, wherein the third paper guide further comprises a bottom surface, a pair of internal edges and a plurality of external edges, wherein a first protrusion extends from the bottom surface of the first unit and a second protrusion extends from the bottom surface of the second unit;

wherein the top surface of the first component of the main body defines a first pair of first paper guide borings adapted to receive the protrusions of the first paper guide, wherein the top surface of the second component of the main body defines a first pair of second paper guide borings adapted to receive the protrusions of the second paper guide, wherein the top surface of the main body defines a first boring adapted to receive the first protrusion of the third paper guide and the top surface of the main body defines a second boring adapted to receive the second protrusion of the third paper guide;

wherein the first pair of first paper guide borings and the first boring are each positioned the same distance from the first internal edge of the main body, wherein the first pair of second paper guide borings and the second boring are each positioned the same distance from the second internal edge of the main body.

6. The placement tool of claim 5, wherein the top surface of the first component of the main body further defines a second pair of first paper guide borings positioned distal to the first pair of first paper guide borings, wherein the second pair of first paper guide borings is adapted to receive the protrusions of the first paper guide;

wherein the top surface of the second component of the main body further defines a second pair of second paper guide borings positioned distal to the first pair of second paper guide borings, wherein the second pair of second paper guide borings is adapted to receive the protrusions of the second paper guide;

wherein the top surface of the main body further defines a third boring positioned distal to the first boring, wherein the third boring is adapted to receive the first protrusion of the third paper guide, wherein the top surface of the main body further defines a fourth boring positioned distal to the second boring, wherein the fourth boring is adapted to receive the second protrusion of the third paper guide;

wherein the second pair of first paper guide borings and the third boring are each positioned the same distance from the first internal edge of the main body, wherein the second pair of second paper guide borings and the fourth boring are each positioned the same distance from the second internal edge of the main body.

7. The placement tool of claim 6, wherein the top surface of the main body defines additional borings being adapted to receive the protrusions of each of the first paper guide, the second paper guide, and the third paper guide, wherein said additional borings correspond to plates having different sizes and said additional borings are each positioned the same distance from the first and second internal edges of the main body.

8. The placement tool of claim 5, wherein the first internal edge and the second internal edge of the main body interest one another to form a plate receiving corner having a curved shape and being adapted to receive a curved corner of a plate;

wherein the pair of internal edges of the third paper guide intersect one another at a ninety degree angle to form a paper receiving corner being adapted to receive a corner of a piece of paper.

9. The placement tool of claim 8, wherein the main body and the plate have the same thickness.

10. The placement tool of claim 5, wherein the internal edge of each of the first and second paper guides defines a pair of sharp corners, wherein the external edge of each of the first and second paper guides defines a pair of rounded corners;

wherein the pair of internal edges of the third paper guide define a pair of sharp corners, wherein the plurality of external edges of the third paper guide define a plurality of rounded corners;

wherein the first internal edge and the second internal edge of the main body define a pair of sharp corners, wherein the plurality of external edges of the main body define a plurality of rounded corners;

wherein the internal edges of the first, second, and third paper guides each face inwardly towards the first and second internal edges of the main body when each of said first, second, and third paper guides are received within the top surface of the main body.

11. A placement tool for printmaking, comprising:

a main body having a first component integrally connected to a second component, wherein the first and second components each have a rectangular shape, a top surface, and form an L-shaped main body, wherein the main body further comprises a first internal edge, a second internal edge, and a plurality of external edges formed by said first and second components, wherein the first internal edge and the second internal edge intersect one another to form a plate receiving corner being adapted to receive a corner of a plate;

a first paper guide and a second paper guide, wherein the first paper guide and the second paper guide are each rectangular in shape, wherein the first paper guide and the second paper guide each have a bottom surface, a pair of opposing ends, an internal edge and an external edge, wherein a peg is positioned adjacent to each of the opposing ends of the first paper guide and the second paper guide, wherein each of said pegs extends from the bottom surface of each of the first paper guide and the second paper guide, wherein a length of the first paper guide is longer than a length of the second paper guide;

a third paper guide having a first unit integrally connected to a second unit, wherein said first and second units each have a rectangular shape, a bottom surface, and form an L-shaped third paper guide, wherein a length of the first unit is longer than a length of the second unit, wherein the third paper guide further comprises a bottom surface, a pair of internal edges and a plurality of external edges, wherein the pair of internal edges of the third paper guide intersect one another at a ninety degree angle to form a paper receiving corner being adapted to receive a corner of a piece of paper, wherein a first peg extends from the bottom surface of the first unit and a second peg extends from the bottom surface of the second unit, wherein the pair of internal edges of the third paper guide intersect one another at a ninety degree angle to form a paper receiving corner being adapted to receive a corner of a piece of paper;

wherein the top surface of the first component of the main body defines a first pair of first paper guide borings adapted to receive the pegs of the first paper guide, wherein the top surface of the second component of the main body defines a first pair of second paper guide borings adapted to receive the pegs of the second paper guide, wherein the top surface of the main body defines a first boring adapted to receive the first peg of the third paper guide and the top surface of the main body defines a second boring adapted to receive the second peg of the third paper guide.

12. The placement tool of claim 11, wherein the top surface of the first component of the main body further defines a second pair of first paper guide borings positioned distal to the first pair of first paper guide borings, wherein the second pair of first paper guide borings is adapted to receive the pegs of the first paper guide;

wherein the top surface of the second component of the main body further defines a second pair of second paper guide borings positioned distal to the first pair of second paper guide borings, wherein the second pair of second paper guide borings is adapted to receive the pegs of the second paper guide;

wherein the top surface of the main body further defines a third boring positioned distal to the first boring, wherein the third boring is adapted to receive the first peg of the third paper guide, wherein the top surface of the main body further defines a fourth boring positioned distal to the second boring, wherein the fourth boring is adapted to receive the second peg of the third paper guide;

wherein the second pair of first paper guide borings and the third boring are each positioned the same distance from the first internal edge of the main body, wherein the second pair of second paper guide borings and the fourth boring are each positioned the same distance from the second internal edge of the main body.

13. The placement tool of claim 12, wherein the top surface of the main body defines additional borings being adapted to receive the pegs of the first paper guide, the second paper guide, and the third paper guide, wherein said additional borings correspond to plates having different sizes and said additional borings are each positioned the same distance from the first and second internal edges of the main body.

14. The placement tool of claim 11, wherein the main body and the plate have the same thickness.

15. The placement tool of claim 11, wherein the internal edge of each of the first and second paper guides defines a pair of sharp corners, wherein the external edge of each of the first and second paper guides defines a pair of rounded corners;

wherein the pair of internal edges of the third paper guide define a pair of sharp corners, wherein the plurality of external edges of the third paper guide define a plurality of rounded corners;

wherein the first internal edge and the second internal edge of the main body define a pair of sharp corners, wherein the plurality of external edges of the main body define a plurality of rounded corners;

wherein the internal edges of the first, second, and third paper guides each face inwardly towards the first and second internal edges of the main body when each of said first, second, and third paper guides are received within the top surface of the main body.

16. The placement tool of claim 11, wherein the main body, the first paper guide, the second paper guide, and the third paper guide are each made of acrylic.

* * * * *